US006897822B2

(12) United States Patent
Sparks et al.

(10) Patent No.: US 6,897,822 B2
(45) Date of Patent: May 24, 2005

(54) SPIRAL RESONATOR-SLOT ANTENNA

(75) Inventors: Kenneth D. Sparks, Glenwood, MD (US); Robert T. Soranno, Baldwin, MD (US)

(73) Assignee: The Johns Hopkins University, Baltimore, MD (US)

( * ) Notice: Subject to any disclaimer, the term of this patent is extended or adjusted under 35 U.S.C. 154(b) by 87 days.

(21) Appl. No.: 10/453,793

(22) Filed: Jun. 3, 2003

(65) Prior Publication Data

US 2003/0222825 A1 Dec. 4, 2003

Related U.S. Application Data

(60) Provisional application No. 60/385,000, filed on Jun. 3, 2002.

(51) Int. Cl.[7] ..... H01Q 13/10
(52) U.S. Cl. ..... 343/767; 343/895; 343/897
(58) Field of Search ..... 343/709, 767, 343/830, 895, 897

(56) References Cited

U.S. PATENT DOCUMENTS 2,812,514 A * 11/1957 Smith ..... 343/767
4,204,212 A * 5/1980 Sindoris et al. ..... 343/700 MS

* cited by examiner

*Primary Examiner*—Shih-Chao Chen
(74) *Attorney, Agent, or Firm*—Albert J. Fasulo, II

(57) ABSTRACT

A resonator-slot antenna is configured to have a spiral of a conducive sheet material having at least one turn and extending along an axis with an elongated antenna slot helically wound around the axis in at least one full twist.

19 Claims, 4 Drawing Sheets

SPIRAL RESONATOR-SLOT ANTENNA

CROSS-REFERENCE TO RELATED APPLICATION

This application claims the benefit of U.S. Provisional Application No. 60/385,000 filed on Jun. 3, 2002, the contents of which are incorporated herein by reference.

STATEMENT OF GOVERNMENTAL INTEREST

This invention was made with Government support under Contract No. N00024-98-D-8124 awarded by the Department of the Navy. The Government has certain rights in the invention.

BACKGROUND OF THE INVENTION

1. Field of the Invention

This invention relates generally to mobile wireless communication systems. More particularly, the present invention relates to mobile resonator-slot antennas.

2. Description of the Related Art

Air-to-ground and air-to-sea communication and radio transmission/reception use surface antennas for a variety of requirements such as, for example, military Ultra High Frequency ("UHF") band (225–400 MHz), LOS, SATCOM, etc. For many years submarine UHF communication with satellites has been accomplished by using wide-band antennas incorporated within an extendable mast. Frequently, raising a mast may compromise the ship's stealth. Furthermore, the original designs may be cumbersome, inefficient and cost prohibitive. Numerous attempts directed to lower power capability of and to improve compactness of wireless systems have been undertaken over a period of time.

As a result, a mast-supporting communication system has been at least partially replaced by a buoyant antenna towed by a submarine. Typically, the existing antenna assemblies are configured to have a rigid cylindrical core wrapped in a conductive material sandwiching a piece of dielectric material that is partially exposed to form a shallow cavity.

One of the first submarine-towed floating resonator-slot antennas providing a foundation for further numerous designs is disclosed in J. C. Lee's paper entitled "A Slender Resonator-Slot UHF Antenna" (M.I.T. Lincoln Laboratory, 1981). This paper discloses a relatively efficient UHF slot antenna extending linearly between its opposite ends and having a straight linear slot backed by a shallow cylindrical cavity of a small diameter, as shown in FIG. 1. While being in a seawater tank and with the antenna slot being kept out of contact with the water surface, the antenna's performance (gain) was satisfactory. When the disclosed resonator-slot antenna was tested at sea, the results were not as good as those produced in the seawater tank.

Among various reasons that may explain lower-than-expected results, the topology of the tested vertically polarized slot-antenna and particularly, the linearly extending slot are rather critical. Conceptually, the tested antenna and its numerous subsequent modifications have been premised on an antenna assembly in which the resonator-slot material stays at the apogee of the hemisphere defined by the floating portion of the assembly. Structurally, as seen in FIG. 1, antenna 2 is configured to have a body of conductive material formed with a slot 8, which is backed by a core 4, and a coaxial feeder 6. Accordingly, any deviation from the ideal position would cause a change in its voltage standing wave ratio, and sufficient shift from the apogee, (i.e. making it parallel to the water), would lead to a de-tuning effect. Once the assembly has reached a position in which the slot deviates at about a 90° from the apogee, the antenna ceases to function, since, as is well known in the art, the electromagnetic waves propagate in a plane extending transversely to the longitudinal direction of the slot. Furthermore, the selection of dielectric materials and the dimensions of the tested antenna may also contribute to unsatisfactory gain characteristics produced by the tested antenna. Since the demand for commercial and military mobile wireless systems is on the rise, it is imperative to develop a simple and reliable structure of a resonator-slot antenna. In particular, as discussed above, the problems confronting a resonator-slot antenna designer are the following: (1) cumbersome antenna topology and (2) antenna efficiency as a function of its orientation.

A need, therefore, exists for a miniature mobile slot antenna configured to be immune to its orientation (or roll) relative to the apogee and to exhibit a satisfactory gain regardless of its position.

SUMMARY OF THE INVENTION

In accordance with the present invention, a mobile antenna having a helical sliver of dielectric material defining a slot in the body of the inventive resonator-slot antenna, successfully meets this need.

The inventive resonator-slot antenna provides both higher gain and roll immunity with no deleterious side effects (except that higher gain does change the pattern from hemispherical, so, the gain is degraded at lower elevation angles), while still exhibiting all advantages of the known configurations of the resonator-slot antenna. In accordance with one aspect of the invention, based on theoretical and experimental data, the antenna's gain is a function of antenna slot twist.

According to a further aspect of the invention, the selection of the high dielectric material incorporated in the inventive structure is critical to the compactness of the inventive resonator without detrimentally affecting its performance. Overall, the resonator-slot antenna includes a sliver of high dielectric material sandwiched between a single conductive sheet.

Furthermore, in accordance with another aspect of the invention related to the optimization of the mechanical tuning of the antenna, the location of the coaxial feeder's point of attachment is selected strictly as a function of the length of the sliver.

A further aspect of the invention relates to a method of fabricating the inventive resonator-slot antenna allowing for a cost efficient and simple structure.

It is, therefore, an object of the present invention to provide a mobile resonator-slot antenna characterized by efficient wideband coverage regardless of the orientation of the slot.

A further object of the present invention is to provide a mobile resonator-slot antenna having a simple, space- and cost-efficient structure.

Another object of the present invention is to provide a low-profile, submarine-towed resonator-slot antenna assembly.

Yet another object of the present invention is to provide a method of manufacturing the inventive resonator-slot antenna.

BRIEF DESCRIPTION OF THE DRAWINGS

The above and other objects, features and advantages will become more readily apparent from the following description of the preferred embodiment of the invention accompanied by the following drawings.

DETAILED DESCRIPTION OF THE PREFERRED EMBODIMENTS

Figure 1:
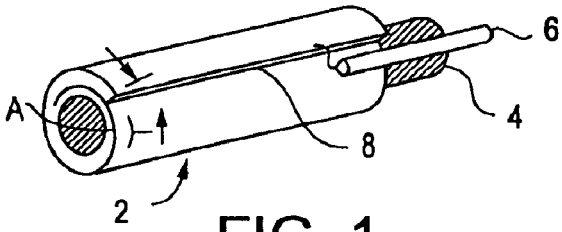
FIG. 1 PRIOR ART
FIG. 1 is a view of resonator-slot antenna configured in accordance with the known prior art.
Figure 2:
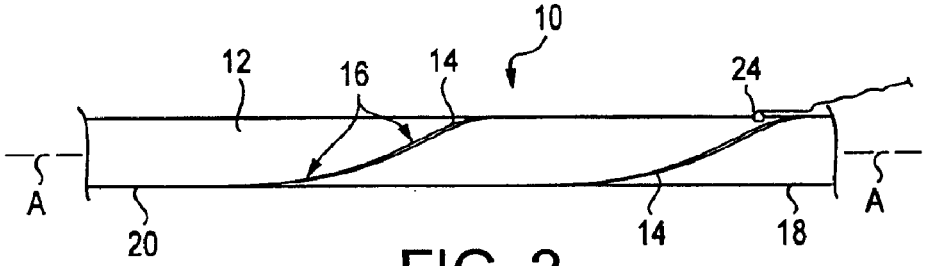
FIG. 2 is a view of the inventive resonant-slot antenna.
Figure 3:
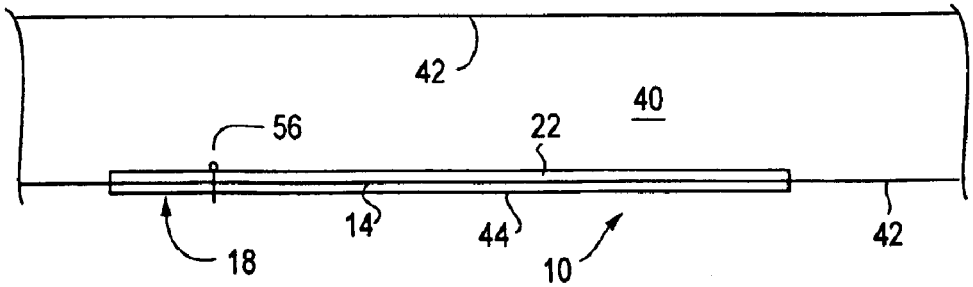
FIG. 3 is a view of the inventive resonant-slot antenna as seen during the initial stage of the manufacturing process.

As shown in FIG. 2, a resonator-slot antenna 10, configured in accordance with the present invention, is space-efficient and characterized by superior radiation efficiency due to a helical sliver 14 of dielectric material sandwiched between a conductive material of body 12 and extending between the body's opposite ends 18 and 20. Coupled to a signal-generating source, such as, for example, cavitron, by a coaxial feeder 24, the antenna 10 is characterized by the desired efficiency in either radiating electro-magnetic waves or picking them up while being towed by a vessel or a motor vehicle. In contrast to the prior art teaching, as illustrated in FIG. 1, the antenna which is optimally efficient only when the straight slot faces away from a horizontal plane (seawater surface), a portion of the inventive sliver 14 is invariably oriented in the desired direction because of its helical shape. While a twist of the sliver 14 equal to at least 180° offers a somewhat enhanced roll immunity, a radiation pattern of at least about 360° around the body 12 produces excellent gain augmentation. Accordingly, a helical slot 16, formed as discussed below, allows for complete immunity of the antenna 10 to the orientation of the body 12. At the same time, the antenna 10 has a gain along and across the slot higher than the one characterized by the prior art antenna as has been evidenced by numerous experiments.

Figure 4:
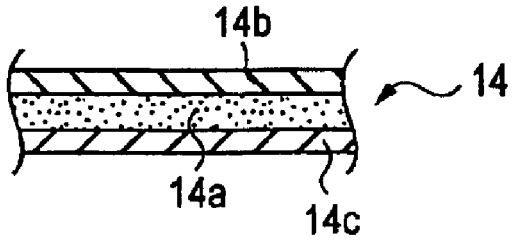
FIG. 4 is a cross-sectional view of a sliver of dielectric material.

Turning to FIGS. 3–6, a process of manufacturing the inventive antenna 10 begins with preparing a foil sheet 40 of conductive material. While the body 12 has been found suitable for providing a desired gain when constructed of shim stock or copper screen/mesh, other high conductance materials can be used as well, e.g., foils such as tin foil, mesh other than copper mesh, gold, silver, MONEL®(a copper-nickel alloy) and aluminum. The foil sheet 40 preferably has a polygonal cross section including, for example, a rectangular or parallelogram shape, and may be cut of, for example, 0.005 pure copper shim stock. Attached to one of longitudinal edges 42 of the foil sheet 40 is the sliver 14 preferably made from dielectric material having the dielectric constant of at least 9, for example, about 10, and characterized by a good flexibility and a good moisture immunity. Preferably, the dielectric material is configured as a laminate having an inner layer 14*a* of dielectric material sandwiched between thin outer faces 14*b*, 14*c* of conductive material, as illustrated in FIG. 4. The dielectric material found to be particularly suitable is a dielectric material 14*a* having a dielectric constant of about 10, e.g., Arlon AR1000 configured to have a woven fiberglass, reinforced ceramic filled PTFE based composite material with a dielectric constant of 10.0.

To form the slot 16, the sliver 14 is treated to have one portion 22, equal roughly to half a top face 46 (FIGS. 5–6), stripped from conductive material 14*b*, whereas the other half 44 of this top face and the bottom face 48 are still covered by this material. Alternatively, the sliver 14 can be machine deposited directly on the edge 42 of the sheet 40. Further, the bottom face 48 is soldered to one of the longitudinal edges 42 of the foil sheet 40. Preferably, the sliver 14 is so attached to the foil sheet 40 that a portion thereof including the half 22 extends beyond the rolled edge 42. Thereafter, this construct is rolled and twisted in such a manner that the sliver 14 forms a helix along the axis A—A, whereas the opposite ends 18 and 20 (FIG. 2) of the body 12 each represent a true spiral having approximately 360 degree turn, as better seen in FIGS. 5–6. As the foil sheet 40 is twisted, the sliver 14 conforms to the helix and provides the slot 16 between juxtaposed surfaces of the foil sheet 40. The process is completed once the sliver 14 is sandwiched between opposite surfaces 50, 52 (FIG. 5) of the sheet 40 overlapping the faces 46, 48 (FIG. 6), respectively, of the sliver 14, with the surface 50 coupled to the copper-covered half 44 of the sliver's top face 46. Accordingly, the antenna 10 is configured with the dielectric material of half 22 of the sliver's top face 46 exposed such that the longitudinal slot 16, defined by the sliver 14, is formed extending along approximately a 360° helical twist around the body 12.

Figure 5:
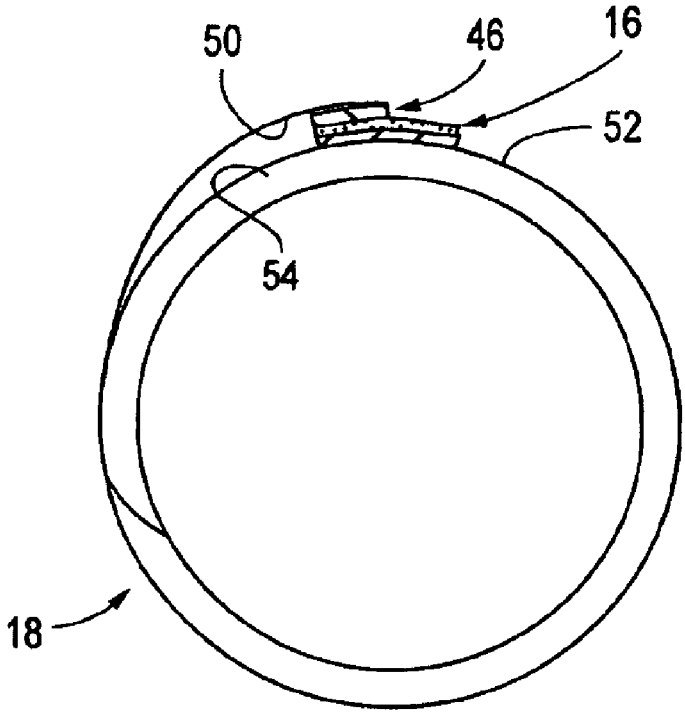
FIG. 5 is a cross-sectional view of the inventive antenna during the manufacturing process thereof at a stage subsequent to the stage illustrated in FIG. 3.
Figure 6:
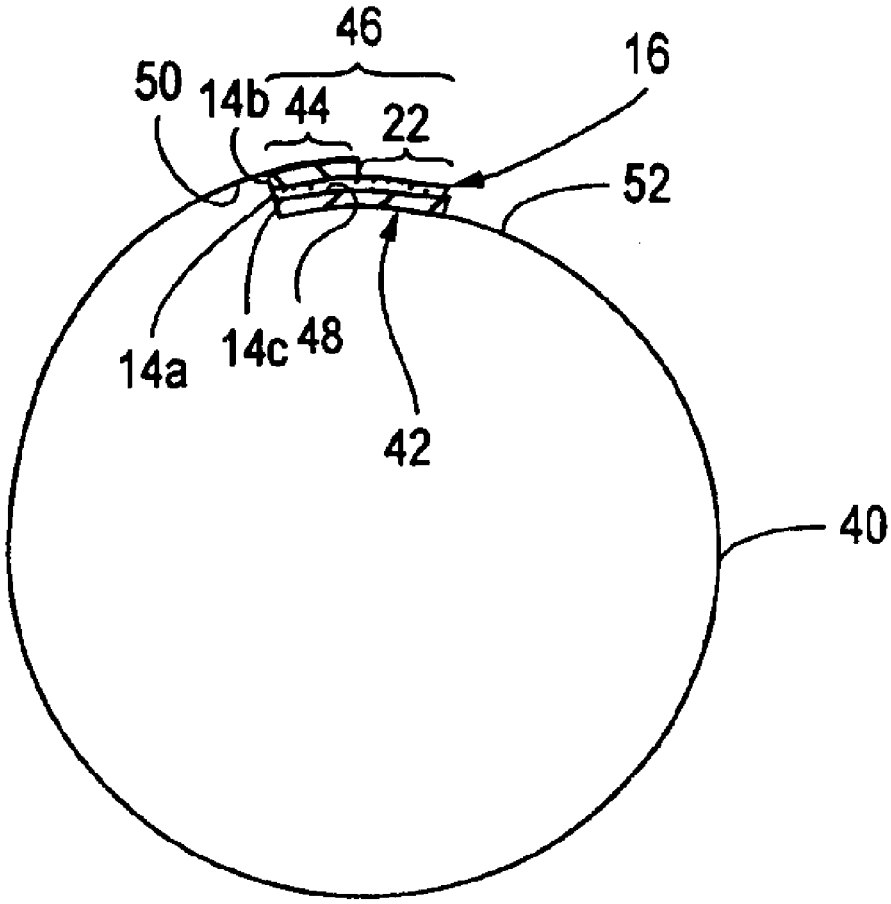
FIG. 6 is a cross-sectional of the resonator-slot antenna manufactured in accordance with the inventive process.

Simplification of the fabrication process is achieved by utilizing a mandrill 54 of appropriate inner diameter, as shown in FIG. 5, and later removed, as illustrated in FIG. 6. While initial stages of the inventive process may differ from one another by optionally using the tube 54, it has been found advantageous to temporarily secure the construct including the foil sheet 40 with the soldered sliver 14 to the tube 54. After twisting the construct to form the annular body 12 (FIGS. 5–6) including approximately a 360° twist of the sliver 14/slot 16, the top face 46 of the sliver 14 is gradually soldered to the sheet 40 by progressively reducing intervals between the soldering points. Thus, the surface 50 of the foil sheet 40 is first soldered to the portion 44 of the sliver 14 every 2", then, upon a cooling period, every 1", and so on until a soldering seam between the sliver and the edge 42 is continuous. Finally, as illustrated in FIG. 5, if used, the tube 54 is removed leaving the antenna 10 with as small an outer diameter as less than about 1" and a thickness of about 0.0005".

The dimensions of the foil sheet 40 are critical in relation to the length of the slot 16 and the diameter of the antenna 10 in yielding roll integrity. Having formed too long or too short the slot 16, one will risk having the antenna 10 exhibit fluctuation in gain v. roll, wherein the roll is the slot's deviation from the apogee of the hemisphere defined by a floating support of the antenna. Furthermore, the coaxial feeder 24 (FIGS. 2, 3 and 7) and its location relative to the length of the slot 16 (or the length of the sliver 14) are also critical to the tuning of the antenna 10. Advantageously, the feeder 24 is attached to the antenna 10 at a tuned point 56 spaced from the leading end 18 of the body 12 at a distance approximating 20% of the entire slot length. The coax feeder 24 may be attached to the inner surface of the body 12 or extend along and attached to the outside thereof. Advantageously, the feeder 24 extends within the body 12 and via the tuned point to have its jacket soldered to the former while having its center conductor soldered to the outer surface 52 (FIG. 6) of the foil sheet 40. To further facilitate the tuning of the antenna 10, a tunable capacitor and/or inductor can be coupled to the antenna.

Thus, the foil sheet 40 forming the body 12 of the antenna 10 functions as the conductive ground plane and the structural member making the resonator-slot antenna 10 a self-supporting coreless structure. However, a core still may be used to enhance structural integrity and/or to improve tuning as long as its material is not RF absorbent and is selected from the group consisting of fiberglass, polyvinyl chloride (PCV), polyurethane, and the like and mixtures thereof.

Figure 7:
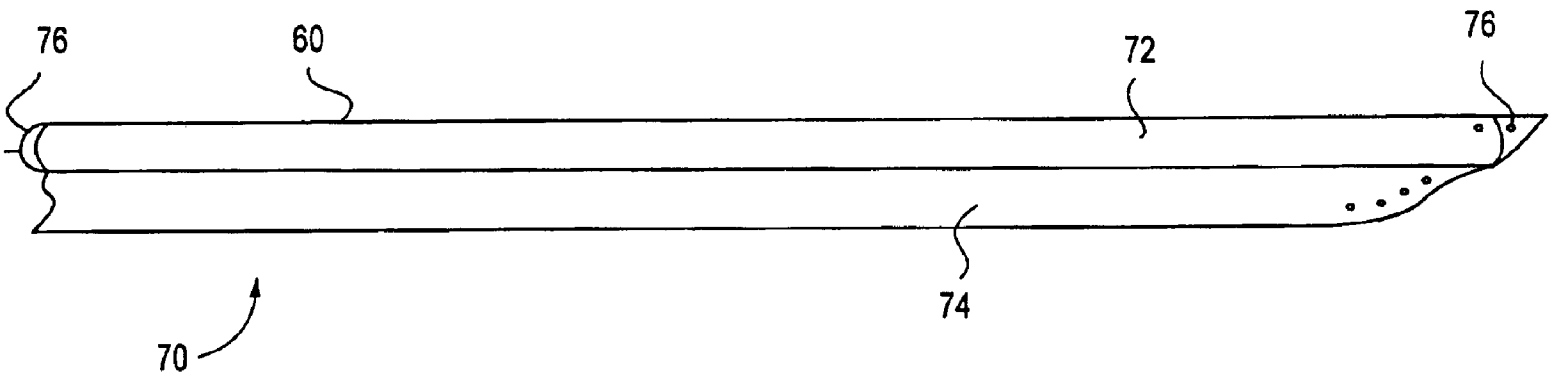
FIG. 7 is a view of one of the embodiments of a floating assembly incorporating the inventive resonator-slot antenna.

The use of the antenna 10 at sea requires isolation from seawater, which is accomplished by enclosing the antenna 10 (not shown) within a radome shell 60, as illustrated in FIG. 7. The inner diameter of the shell 60 is only slightly greater than the outer diameter of the antenna. Various materials selected for the shell 60 may include, but not limited to a fiberglass composition and rigid foams subject only to the enhanced buoyancy. Overall, an antenna assembly 70 including the shell 60 and the antenna 10 is specifically configured for use by submarine or vessels. As can be seen, the assembly is low profiled and has a keel 74 to provide stability to the towable assembly even at high speeds of a towing vessel. As shown, the shell has a kill. Preferably, however, the shell 60 has a cylindrical body sealed by and end-pieces 76 to prevent water penetration inside the shell.

The desired frequency band dictates the final overall length and diameter of the antenna 10 which is a function of the sliver's length 14 defined between its ends 18, 20. Each of the ends 18, 20 is covered by copper/solder to terminate the effective length of the dielectric element and, as a consequence, of the entire antenna. Typically, higher frequencies require a smaller antenna and lower frequencies dictate a larger antenna. Furthermore, the dielectric constant of the used material also affects the length, width, and thickness of the sliver 14 and the overall size of the resonator-slot antenna 10.

While the invention has been shown and described with reference to a certain preferred embodiment thereof, it will be understood by those skilled in the art that various changes in form and details may be made therein without departing from the spirit and scope of the invention as defined by the appended claims.

What is claimed is:

1. A resonator-slot antenna comprising:

a spiral of a conductive sheet material having at least one turn and extending along an axis with an elongated antenna slot helically wound around the axis in at least one full twist, wherein the conductive sheet material has initially a polygonal shape defined between two spaced-apart axial edges juxtaposed with one another to define a helical seam of a body of the resonator-slot antenna formed after the sheet material has been rolled and twisted; and a sliver of a dielectric material coupled to either of the axial edges and configured to be substantially smaller than the conductive sheet material to be sandwiched by the conductive sheet material along the seam of the body.

2. The resonator-slot antenna of claim 1, wherein at least one full twist is at least of about 360°.

3. The resonator-slot antenna of claim 1, wherein the conductive sheet material is selected from the group consisting of foil, copper mesh, gold, silver, MONEL®, aluminum and mixtures thereof.

4. The resonator-slot antenna of claim 1, wherein the sliver of the dielectric material has a portion overhanging one of the axial edges, so that when the body is formed, the axial edges overlap opposite faces of the sliver of dielectric material and coupled thereto.

5. The resonator slot antenna of claim 1, wherein the body is hollow or provided with a low dielectric core comprising a buoyant material and the dielectric material of the sliver having a dielectric constant of about 10 and being moisture immune.

6. The resonator slot antenna of claim 1, wherein the buoyant material is selected from the group consisting of fiberglass, polyvinyl chloride, polyurethane and a combination thereof.

7. The resonator-slot antenna of claim 1, further comprising a coaxial feeder having one of opposite ends thereof for coupling to a signal source/receiver, the opposite end of the coaxial feeder being coupled to the sheet of conductive material at a tuned point and extending along about 20% of a total length of the sliver.

8. The resonator-slot antenna of claim 7, wherein the tuned point includes a hole in the sheet of conductive material traversed by the opposite end of the coaxial feeder from an interior of the body out or from outside into the interior.

9. The resonator-slot antenna of claim 7, wherein the sheet of conducting material constitutes a ground plane of the resonator-slot antenna and configured to provide the resonator-slot antenna with a self-supporting structure.

10. The resonator-slot antenna of claim 9, further comprising a shell provided with a cylindrical body having an inner surface, which is radially juxtaposed with the body of the resonator-slot antenna and made from moisture immune material.

11. A resonator-slot antenna-assembly for towing by a submarine or a surface vessel, comprising:

an annular body made from conducive material and having two edges spaced laterally from a longitudinal axis of the annular body in opposite directions;

a sliver of dielectric material sandwiched between the two edges to form an axial antenna slot helically wound around the annular body in at least one full twist of about 360° to form a resonator-slot antenna; and a floating shell housing the resonator-slot antenna and being displaceably fixed therewith, wherein the resonator-slot antenna is immune to a roll of the resonator-slot antenna in sea water.

12. The resonator-slot antenna of claim 11, wherein the sliver the has a portion projecting laterally beyond one of the edges.

13. The resonator-slot antenna of claim 12, further comprising a coaxial feeder having one of opposite ends thereof coupled to the sheet material at a tuned point, the resonator-slot antenna being configured to have an outer diameter, a length and thickness of the sliver, a location of the tuned point and a number of revolutions of the sliver a function of desired frequency.

14. The resonator-slot antenna assembly of claim 13, wherein the outer diameter resonator-slot antenna is dictated by operating frequency and dielectric sliver material, the tuned point being located at a distance from a leading end of the sliver corresponding to about 20% of the length of the sliver.

15. A method for fabricating a resonator-slot antenna comprising the steps of:

providing a longitudinal sliver of dielectric material;

fusing the longitudinal sliver to one of opposite surfaces of a sheet of conductive material covering the sliver;

forming an annular body by rolling and twisting the sheet of conductive material to form a helical longitudinal slot of the resonator-slot antenna defined by the longitudinal sliver sandwiched between juxtaposed portions of the sheet; and coupling the sliver to the other surface of the sheet of conductive material.

16. The method of claim 15, wherein the annular body is twisted to form at least one about 360° helical twist of the sliver of dielectric material.

17. The method of claim 15, wherein the coupling of the sheet of conductive material to the sliver includes:

(a) selectively soldering one of opposite surfaces of the sheet along a respective longitudinal edge thereof to one face of the sliver, thereby forming a first plurality of spaced apart soldered regions, each pair of which defines a respective space;

(b) cooling the soldered sliver and the sheet; and (c) soldering the spaces between the initially soldered regions; and (d) soldering the opposite surface of the sheet to a face of the sliver opposite to the one face by repeating steps (a) through (c) upon rolling another longitudinal edge of the sheet to form the annular body with a continuous helical slot defined by the sliver and equal to about 360 degrees.

18. The method of claim 17, further comprising attaching a coaxial feeder to the annular body at a tuned point located between leading and trailing ends of the annular body.

19. The method of claim 18, wherein the tuned point is spaced from the leading end of the annular body by a distance equal to about 20% of an entire length of the sliver.

* * * * *